US007963575B2

(12) United States Patent
Mayo et al.

(10) Patent No.: US 7,963,575 B2
(45) Date of Patent: Jun. 21, 2011

(54) GATE LATCH

(75) Inventors: Stephen K. Mayo, West Chester, OH (US); William John Bryant, Dayton, OH (US)

(73) Assignee: Evenflo Company, Inc., Miamisburg, OH (US)

( * ) Notice: Subject to any disclaimer, the term of this patent is extended or adjusted under 35 U.S.C. 154(b) by 811 days.

(21) Appl. No.: 11/706,073

(22) Filed: Feb. 14, 2007

(65) Prior Publication Data

US 2008/0191497 A1 Aug. 14, 2008

(51) Int. Cl.
*E05C 1/12* (2006.01)
*E05C 1/02* (2006.01)

(52) U.S. Cl. ..... 292/169; 292/140; 292/163; 292/165; 292/DIG. 29; 292/DIG. 37; 160/225; 49/57

(58) Field of Classification Search ..... 292/137, 292/140, 143, 163, 165, 173, DIG. 29, DIG. 37; 160/261, 225; 49/55, 57, 394
See application file for complete search history.

(56) References Cited

U.S. PATENT DOCUMENTS

| | | | | |
|---|---|---|---|---|
| 793,087 | A * | 6/1905 | McVitty | 70/214 |
| 2,479,256 | A * | 8/1949 | Radcliffe | 292/165 |
| 4,231,597 | A * | 11/1980 | Pelcin | 292/164 |
| 4,481,737 | A | 11/1984 | Rebhan et al. | |
| 4,607,455 | A | 8/1986 | Bluem et al. | |
| 4,611,431 | A | 9/1986 | Lauro | |
| 4,677,791 | A | 7/1987 | Larson et al. | |
| 4,702,036 | A | 10/1987 | Johnson | |
| 4,787,174 | A | 11/1988 | Brown | |
| 4,831,777 | A | 5/1989 | Johnson, Jr. | |
| 4,884,614 | A | 12/1989 | Spurling | |
| 4,944,117 | A | 7/1990 | Gebhard et al. | |
| 5,052,461 | A | 10/1991 | Stern | |
| 5,117,585 | A | 6/1992 | Andrisin, III | |
| 5,272,840 | A | 12/1993 | Knoedler et al. | |
| 5,367,829 | A | 11/1994 | Crossley et al. | |
| 5,396,732 | A | 3/1995 | Andersen | |
| 5,437,115 | A | 8/1995 | Freese et al. | |
| 5,442,881 | A | 8/1995 | Asbach et al. | |
| 5,528,859 | A | 6/1996 | Taylor et al. | |
| 5,531,258 | A | 7/1996 | Poulson et al. | |
| 5,535,552 | A | 7/1996 | Stern | |
| 5,638,885 | A | 6/1997 | Freese et al. | |
| 5,782,039 | A | 7/1998 | Scherer et al. | |
| 5,829,505 | A | 11/1998 | Brescia | |
| 5,924,242 | A | 7/1999 | Macari et al. | |

(Continued)

OTHER PUBLICATIONS

Unknown, Wood Swing Gate, A Division of Dorel Juvenile Group, Inc., http://www.djgusa.com/printable.asp?ProductID=2538, Mar. 27, 2006.

(Continued)

*Primary Examiner* — Carlos Lugo
(74) *Attorney, Agent, or Firm* — Taft Stettinius & Hollister LLP

(57) ABSTRACT

A gate latch assembly comprising: (a) a biased latchbolt repositionable between a retracted position and an extended position; (b) a latchbolt catch to receive the latchbolt; and (c) a two-stage mechanism for repositioning the latchbolt from the extended position to the retracted position including a first stage mechanism having a clutch for selectively engaging the latchbolt, and a second stage mechanism for repositioning the latchbolt from the extended position to the retracted position while the clutch is engaged, where the second stage mechanism is repositionable independent of the latchbolt when the clutch is not engaged.

8 Claims, 11 Drawing Sheets

U.S. PATENT DOCUMENTS

| | | | | |
|---|---|---|---|---|
| 6,016,629 | A | 1/2000 | Sylvester et al. | |
| 6,112,461 | A * | 9/2000 | Cheng | 49/55 |
| 6,161,334 | A | 12/2000 | Goodin | |
| 6,176,042 | B1 | 1/2001 | Rossman et al. | |
| 6,179,352 | B1 * | 1/2001 | Schneeberger | 292/347 |
| 6,233,874 | B1 | 5/2001 | Johnson, Jr. | |
| 6,253,490 | B1 | 7/2001 | Postans | |
| 6,370,823 | B1 | 4/2002 | Andersen | |
| 6,425,609 | B2 * | 7/2002 | Cheng | 292/5 |
| 6,446,395 | B2 | 9/2002 | Rogers | |
| 6,449,901 | B1 | 9/2002 | Gibree et al. | |
| 6,499,254 | B2 | 12/2002 | Rossman et al. | |
| 6,536,163 | B1 | 3/2003 | Monahan et al. | |
| 6,536,502 | B2 | 3/2003 | Britto et al. | |
| 6,655,087 | B2 | 12/2003 | Andersen | |
| 6,681,523 | B1 | 1/2004 | Stener | |
| D502,551 | S | 3/2005 | Hotaling et al. | |
| 7,540,046 | B1 * | 6/2009 | Lai | 5/100 |
| 7,627,985 | B2 * | 12/2009 | Marsden et al. | 49/50 |
| 2006/0207180 | A1 * | 9/2006 | Cheng | 49/57 |
| 2007/0074453 | A1 * | 4/2007 | Flannery | 49/57 |

OTHER PUBLICATIONS

Unknown, http://www.securebaby.com/images/baby_gates/sb42046, Mar. 27, 2006.

* cited by examiner

GATE LATCH

FIELD OF THE INVENTION

The present invention is directed to selectively engagable retention members and, more specifically, to gate latches for repositionable and expandable gates.

INTRODUCTION TO THE INVENTION

It is a first aspect of the present invention to provide a gate latch assembly comprising: (a) a biased latchbolt repositionable between a retracted position and an extended position; (b) a latchbolt catch to receive the latchbolt; and (c) a two-stage mechanism for repositioning the latchbolt from the extended position to the retracted position including a first stage mechanism having a clutch for selectively engaging the latchbolt, and a second stage mechanism for repositioning the latchbolt from the extended position to the retracted position while the clutch is engaged, where the second stage mechanism is repositionable independent of the latchbolt when the clutch is not engaged.

In a more detailed embodiment of the first aspect, the second stage mechanism includes a cam and a follower, and the cam and follower cooperate to transform motion in a first direction into motion in a second direction, where the second direction is substantially perpendicular to the first direction. In yet another more detailed embodiment, a first covering at least partially housing the second stage mechanism, and a second covering at least partially housing the first covering, the second covering pivotally mounted to the first covering, where the second covering includes the follower, and where the cam is repositionable with respect to the first covering and the second covering. In a further detailed embodiment, the first covering includes complementary panels majority enclosing the two-stage mechanism, and the complementary panels cooperate to form guides to guide the movement of the latchbolt between the extended position and the retracted position. In still a further detailed embodiment, the latchbolt includes a repositionable pin traversing along a pin guide, the pin includes at least one of a projection or a cavity that engages the pin guide to selectively reposition the pin when the pin guide is repositioned, and the pin guide is selectively engaged by the clutch. In a more detailed embodiment, the pin includes a proximal projection, the pin includes alignment features that interact with corresponding features of the first covering to guide traversal of the pin, the first covering includes an orifice though which the proximal projection extends in the extended position, and the second covering includes an office through which the proximal projection extends in the extended position.

In yet another more detailed embodiment of the first aspect, the cam includes a triangular projection having a hypotenuse as a camming surface, the follower comprises a cylinder, and the camming surface slides along an exterior of the cylinder to transform vertical motion into horizontal motion. In still another more detailed embodiment, the latchbolt includes a detent receiver, the second stage mechanism includes a cam and a follower, the clutch comprises and actuator and a biased detent, the biased detent is coupled to the cam, the biased detent is biased to a disengaged position with respect to the detent receiver, and the actuator is operative to reposition the biased detent to an engaged position with respect to the detent receiver, the cam and follower cooperate to transform motion in a first direction into motion in a second direction, motion in the second direction is transferred to the latchbolt when the biased detent is in the engaged position. In a further detailed embodiment, a first covering at least partially housing the second stage mechanism, and a second covering at least partially housing the first covering, the second covering pivotally mounted to the first covering, where the second covering includes the follower, and where the cam is repositionable with respect to the first covering and the second covering. In still a further detailed embodiment, the clutch includes at least two pivotally mounted arms, each of the at least two arms includes a detent to engage a corresponding cavity of the latchbolt, the at least two arms are biased apart from one another to inhibit engagement of each detent with its corresponding cavity of the latchbolt, and the clutch is manually repositionable to overcome the bias of the at least two arms to force the at least two arms toward one another and direct each detent into engagement with its corresponding cavity of the latchbolt to facilitate movement of the latchbolt from the extended position to the retracted position.

It is a second aspect of the present invention to provide a gate latch assembly comprising: (a) a first housing at least partially covering a latching mechanism, the latching mechanism including a latching element repositionable between an engaged position and a disengaged position, where the latching element includes at least one of a latchbolt and a latchbolt cavity, where the latching element is operative to cooperate with a counterpart latching element, comprising the other of the latchbolt and the latchbolt cavity, to comprise a latch; and (b) a second housing at least partially covering the first housing, the second housing pivotally mounted to the first housing, where the latching mechanism includes a transformer selectively converting pivotal motion between the first housing and the second housing into motion of the latching element to reposition the latching element from the engaged position to the disengaged position, and where the latching mechanism includes a clutch selectively coupling the transformer to the latching element.

In yet another more detailed embodiment of the second aspect, the transformer includes a cam and a follower, the follower is mounted to the second housing, and the cam is repositionable mounted to the first housing. In still another more detailed embodiment, the cam comprises an upstanding feature having a camming surface generally perpendicular to a line of travel of the cam, the camming surface slides against a surface of the follower to reposition the cam vertically and horizontally with respect to the follower. In a further detailed embodiment, the clutch comprises a repositionable part that selectively engages with a corresponding part of the latching element when the clutch is engaged, and the clutch is mounted to the transformer It is a third aspect of the present invention to provide a repositionable barrier comprising: (a) a gate frame; (b) a repositionable gate door cooperating with the gate frame to provide a barrier across an area having a width and a height cooperatively defined by the gate frame and gate door when the gate door is in a closed position; and (c) a gate latch assembly to retain the gate door in the closed position and operative to selectively allow repositioning of the gate door from the closed position, the gate latch assembly comprising: (i) a latching element, comprising a latchbolt or a latchbolt receiver, repositionable between an engaged position and a disengaged position, (ii) a two stage catch mechanism to engage and reposition the latching element from the engaged position to the disengaged position, the two stage catch mechanism including a first stage clutch operative to selectively couple the catch mechanism to the latching element, and a second stage drive mechanism to reposition the latching element from the engaged position to the disengaged position after the first stage clutch has been engaged, and (iii) a counterpart latching element comprising the other of the latchbolt or the latchbolt receiver, where the latching element is mounted to one of the gate frame and the repositionable door, and where the counterpart latching element is mounted to the other of the gate frame and the repositionable door opposite the latching element.

In yet another more detailed embodiment of the third aspect, a first housing at least partially housing the latching element and the two stage catch mechanism, and a second housing pivotally mounted to the first housing, where pivotal movement between the first housing and second housing engages the second stage drive mechanism, and where pivotal movement between the first housing and second housing is operative to reposition the latching element when the clutch is engage.

It is a fourth aspect of the present invention to provide a method of actuating a repositionable gate latch, the method comprising: (a) providing a gate latch receiver and a gate latch assembly that are operative to form a coupled latch when engaged, where the gate latch includes a latching feature, a clutch, and a driving mechanism selectively engaged by the clutch to reposition the latching feature, and where the latching feature selectively engages the gate latch receiver; (b) actuating the clutch of the gate latch to couple the driving mechanism to the latching feature; and (c) actuating the driving mechanism, after the clutch is actuated, to reposition the latching feature from an engaged position with the gate latch receiver to a disengaged position with respect to the gate latch receiver.

In still another more detailed embodiment of the fourth aspect, the clutch is manually actuated, and the driving mechanism is manually actuated. In a further detailed embodiment, the gate latch assembly includes a first housing at least partially enclosing the gate latch, the gate latch assembly includes a second housing pivotally mounted to the first housing, further comprising the act of pivoting a first housing with respect to a second housing so that a portion of the first housing engages the driving mechanism to actuate the driving mechanism. In still a further detailed embodiment, the act of pivoting the first housing with respect to the second housing includes applying a downward pressure opposite an index finger and thumb approximate a heel of a hand, while at least initially maintaining the clutch in an actuated position to reposition the latching feature from an engaged position with the gate latch receiver to a disengaged position with respect to the gate latch receiver.

It is a fifth aspect of the present invention to provide a method of actuating a repositionable gate latch, the method comprising: (a) gripping a pair of opposed detents with an index finger and thumb to reposition the pair of detents into engagement with a repositionable latching pin, where the pair of opposed detents are part of a driving mechanism selectively operative to reposition the latching pin; and (b) applying downward pressure opposite the index finger and thumb approximate a heel of a hand, while at least initially maintaining the pair of detents in the collapsed position, to engage the driving mechanism and retract the latching pin.

DETAILED DESCRIPTION

The exemplary embodiments of the present invention are described and illustrated below to at least include methods of engaging and disengaging latches for repositionable and expandable gates, as well as devices to selectively couple gate doors to gate frames. Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
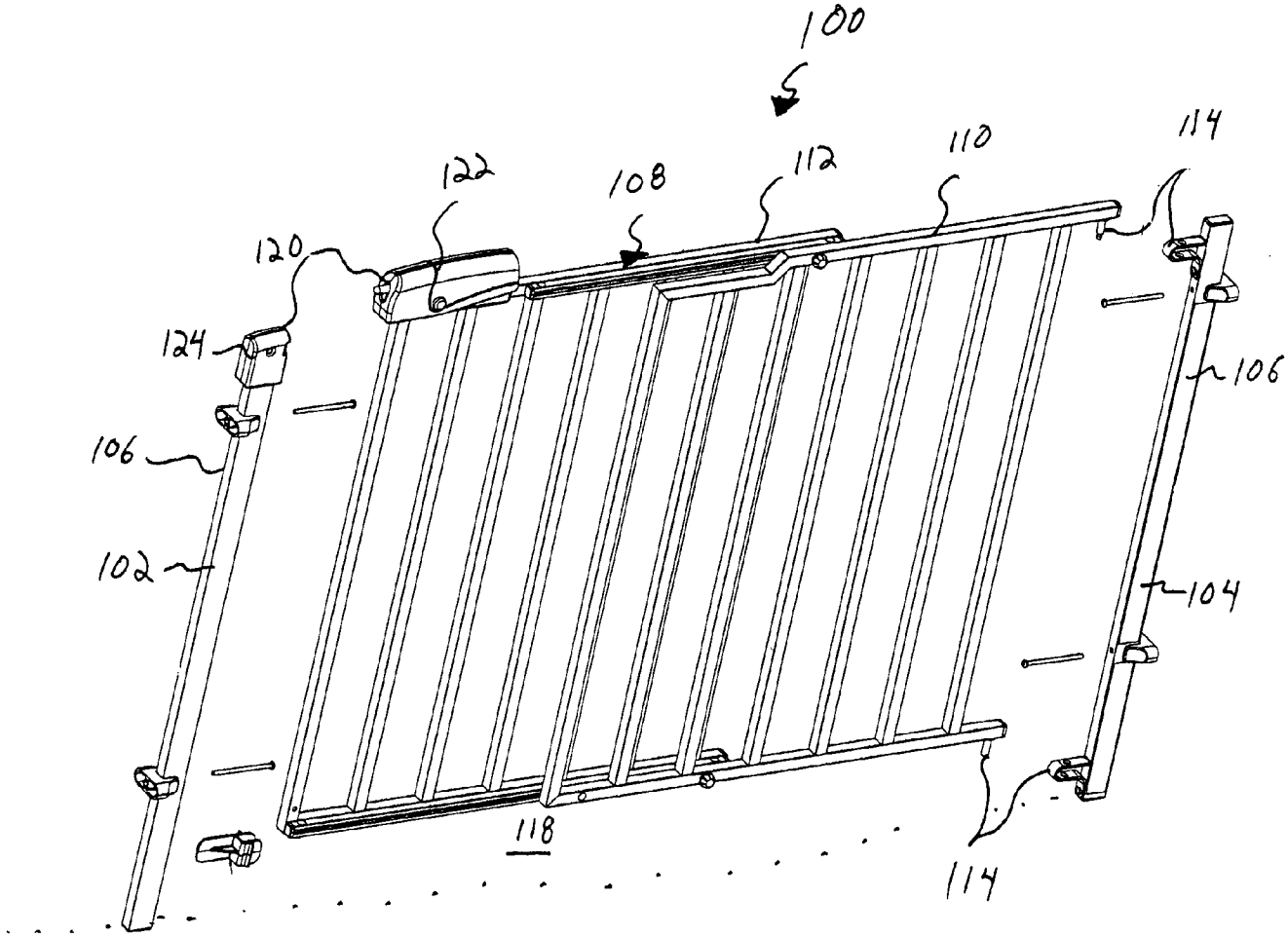
FIG. 1 is a partially exploded, elevated perspective view of an exemplary expandable gate in accordance with the present invention.

Referencing FIG. 1, an exemplary embodiment of the present invention includes a repositionable gate 100 for spanning across openings to inhibit egress though such openings. Uses for repositionable gates 100 of this type may include spanning doorways and stairwells to inhibit egress of children and pets that might be injured or themselves cause damage if allowed to egress into certain areas. In exemplary form, the gate is positioned to span a doorway so that the ends 102, 104 of the gate frame 106 abut the doorway on opposing sides. An expandable swinging door 108, comprising a first gate segment 110 slidably mounted to a second gate segment 112, is mounted to the gate frame 106 on one end 104 using hinges 114 that allow the door to be open and closed. In this exemplary embodiment, the gate door 108 is repositionable from its barrier position (shown in FIG. 1) to an open position on the inbound side 116 of the doorway or to an open position on the outbound side 118 of the doorway (separated by an imaginary plane shown as a dotted line in FIG. 1).

Referring to FIG. 1, the repositionable gate 100 includes a gate latch 120 to maintain the gate door 108 in its barrier position. The exemplary gate latch 120 includes a dual action mechanism that requires two distinct movements to disengage the latch 120 before the door 108 is free to be swung to either the inbound side 116 and the outbound side 118 of the doorway. The latch 120 includes a latch handle assembly 122 mounted to a top corner of the second gate segment 112 opposite the hinges 114, and a latch catch assembly 124 mounted to a top portion of the gate frame 106 on a corresponding end 102 opposite the latch handle assembly.

Figure 3:
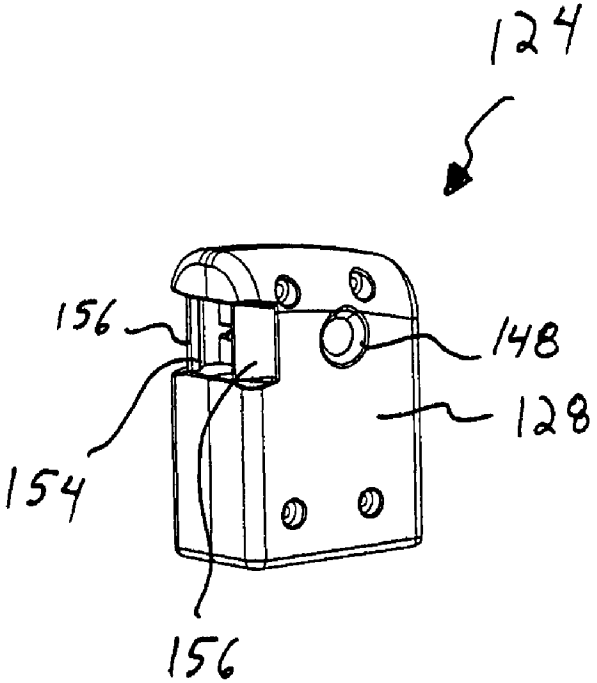
FIG. 3 is an elevated perspective view of the assembled latch catch assembly of FIG. 2.
Figure 2:
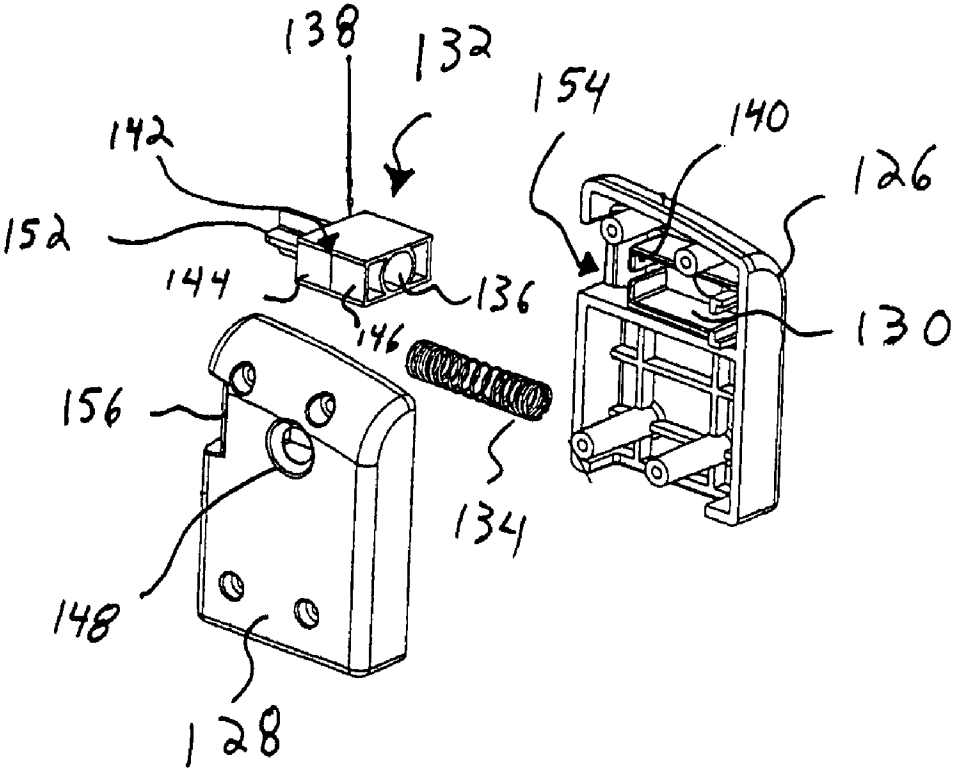
FIG. 2 is an exploded view of an exemplary latch catch assembly in accordance with the present invention.

Referencing to FIGS. 2 and 3, the exemplary latch catch assembly 124 includes complementary left and right side housings 126, 128 cooperating to define a cavity 130 accommodating longitudinal travel of an indicator pin 132. A spring 134 is partially housed within a cylindrical pocket 136 of the pin 132 and is operative to bias the pin in its forwardmost position. In its forward most position, a front rectangular face 138 of the pin 132 is adjacent to a front face 140 on the inside of the housings that defines the cavity 130. A colored indicator 142 on the side of the pin 132 includes two rectangular colored blocks 144, 146 (each colored differently), with one of the colored blocks being visible through an opening 148 in the right side housing 128. As will be discussed in more detail later, a dowel 150 of the latch handle assembly 124 contacts a forward portion 152 of the pin 132 when the gate door 108 is in its barrier position. When the door 108 is in its barrier position, the bias of the spring 134 is overcome by the bias of the dowel 150 and secures the dowel within a forward recess 154 of the latch catch assembly 124. As the bias of the spring 134 is being overcome by insertion of the dowel 150, the pin 132 is moved rearward so that the first colored block 146 is no longer visible though the opening 148, but rather the second colored block 144 is visible, thereby objectively indicating that the door is in its barrier position. Opposing angled faces 156 on the left and right side housings 126, 128 operate to guide the dowel 150 into the recess 154 and concurrently overcome the bias of the dowel causing it to recede prior to insertion into the recess. A series of fastener channels 158 associated with each of the left and right side housings 126, 128 receive fasteners (not shown), such as screws, to mount the housing to one another and sandwich the pin 132 and spring 134 therebetween.

Figure 4:
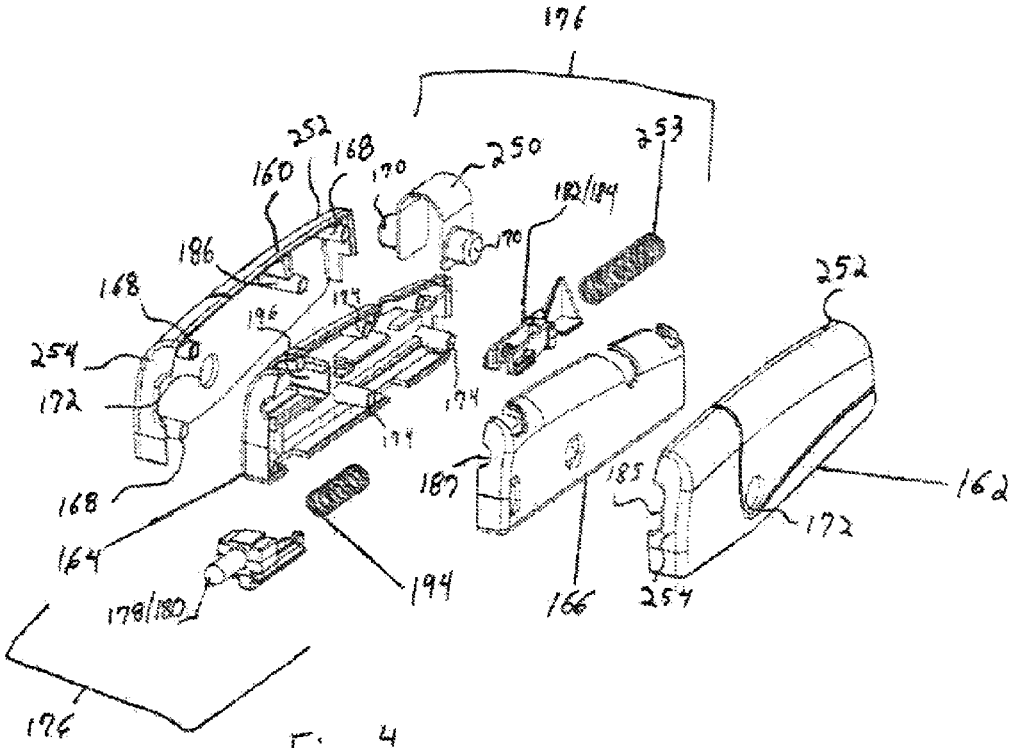
FIG. 4 is an exploded view of an exemplary latch handle assembly in accordance with the present invention.

Referring to FIG. 4, the latch handle assembly 122 in exemplary form includes right and left side outer housings 160, 162 that at least partially cover right and left side inner housings 164, 166. Each outer housing 160, 162 includes a plurality of fastener channels 168 that receive a fastener (not shown), such as a screw, to mount the housings to one another. When the outer housings 160, 162 are mounted to one another, a cavity is formed therebetween, which is eventually occupied by the assembled inner housings 164, 166. Two projections 170 extending from the interior of the assembled inner housings 164, 166 likewise extend through corresponding orifices 172 through each of the outer housings 160, 162 to provide an axel upon which the outer housings 160, 162 pivot with respect the inner housings 164, 166. Each inner housing 164, 166 also includes a plurality of fastener channels 174 that receive a fastener (not shown), such as a screw<to mount the housings to one another.

Figure 13:
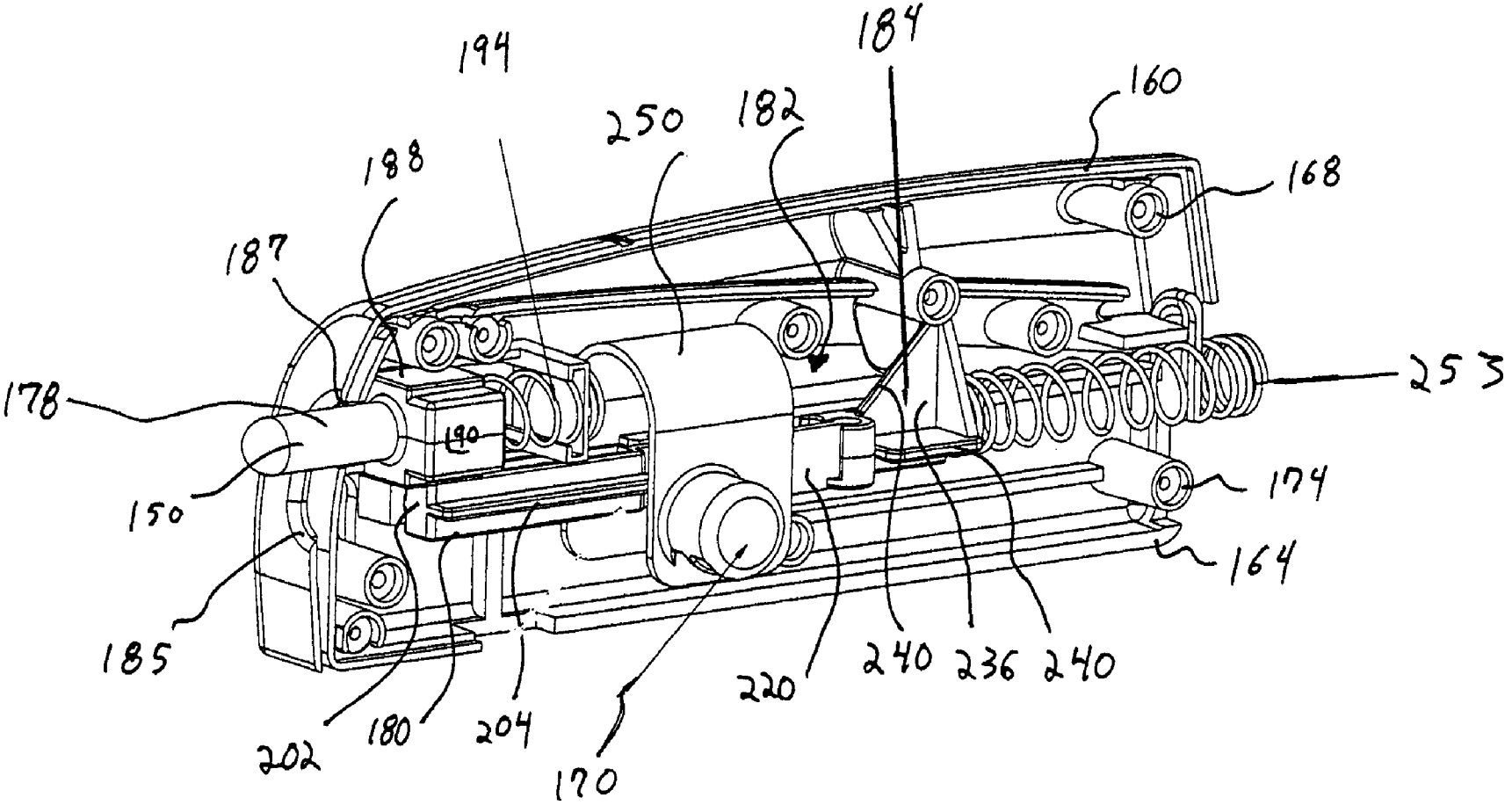
FIG. 13 is an elevated perspective view of the exemplary latch handle assembly of FIG. 4, with the inner and outer left side housings removed, and shown with the dowel in an extended position.
Figure 14:
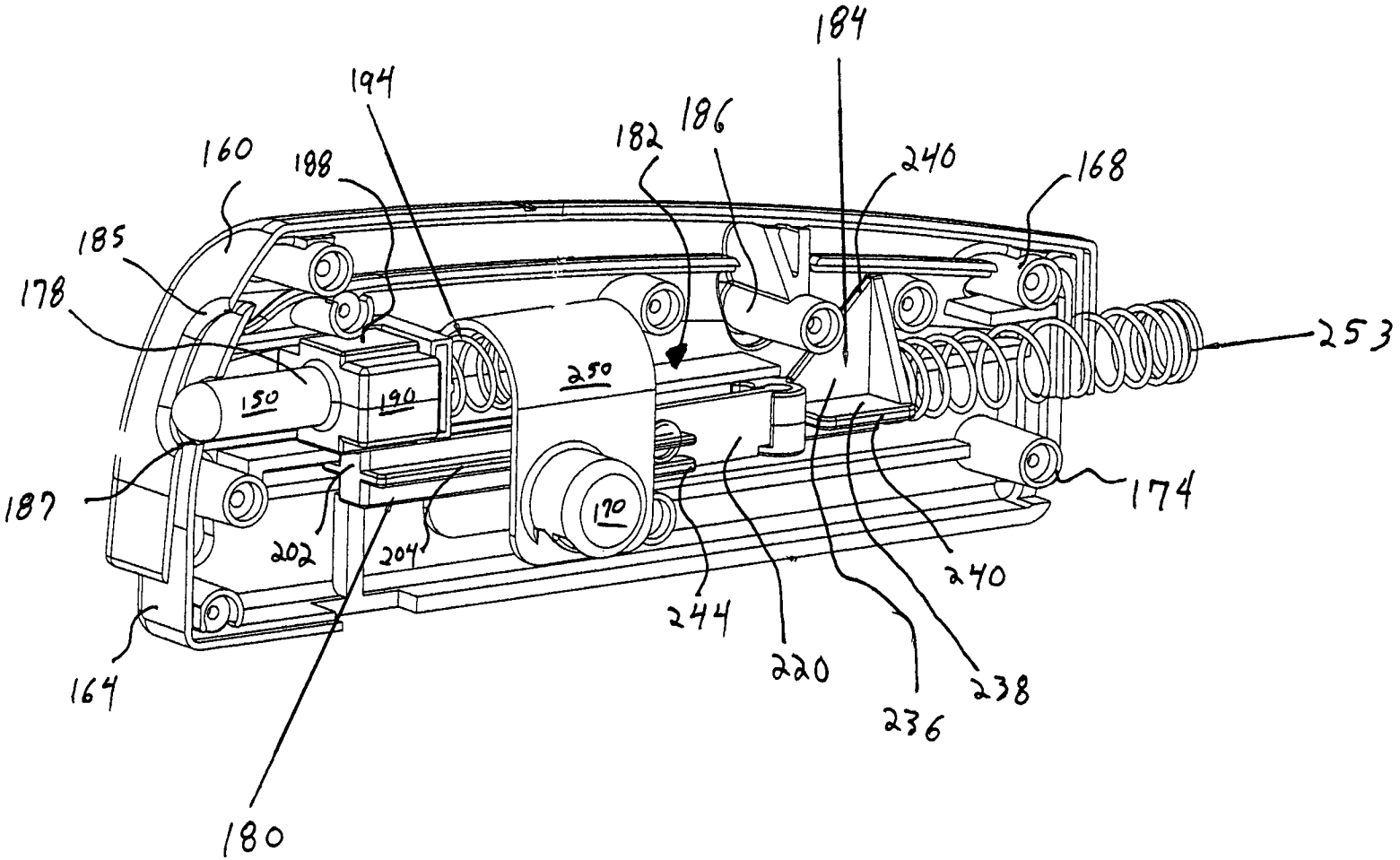
FIG. 14 is an elevated perspective view of the exemplary latch handle assembly of FIG. 4, with the inner and outer left side housings removed, and shown with the dowel in a retracted position.

The assembled inner housings 164, 166 define an internal cavity accommodating a latch mechanism 176. In exemplary form, the latch mechanism 176 includes a repositionable pin 178, a pin guide 180, a clutch 182, and a cam 184 that cooperate with a follower 186 mounted to the right outer housing 160 to reposition the pin 178 from an engaged position to a disengaged position (compare FIGS. 13 and 14). Outer housings 160, 162 cooperate to define a frontal opening 185 that circumscribes a smaller opening 187 formed by the inner housings 164, 166 through which the dowel 150 extends. As previously discussed, the outer housings 160, 162 pivot with respect to the inner housings 164, 166 and the larger opening 185 through the outer housings accommodates the vertical traversal of the housings 160, 162 with respect to the dowel 150.

Figure 6:
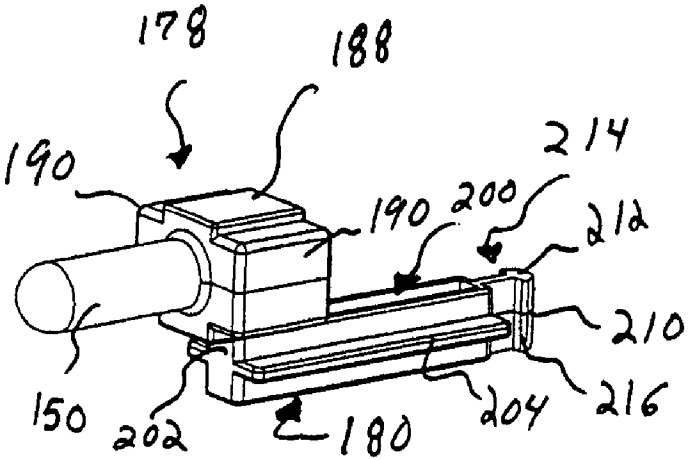
FIG. 6 is an elevated perspective view of an exemplary pin and pin guide engaged with one another.
Figure 5:
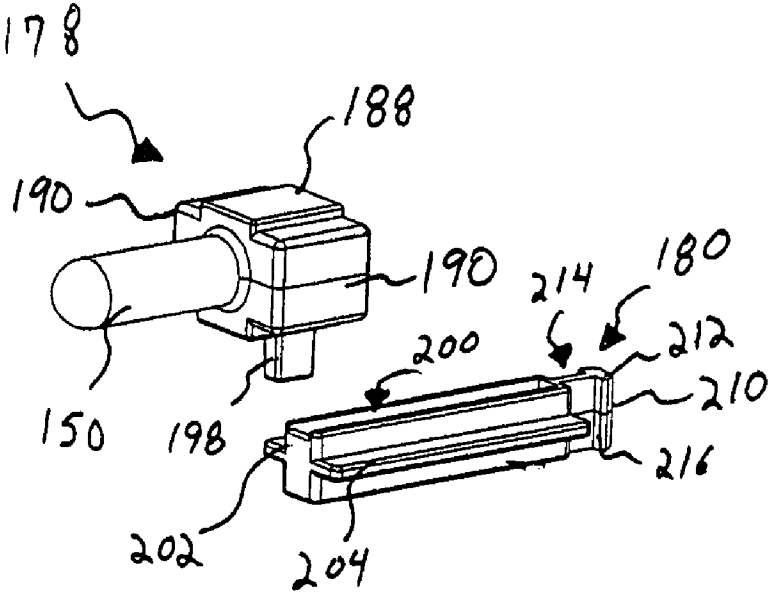
FIG. 5 is an elevated perspective view of an exemplary pin and pin guide disengaged from one another.
Figure 7:
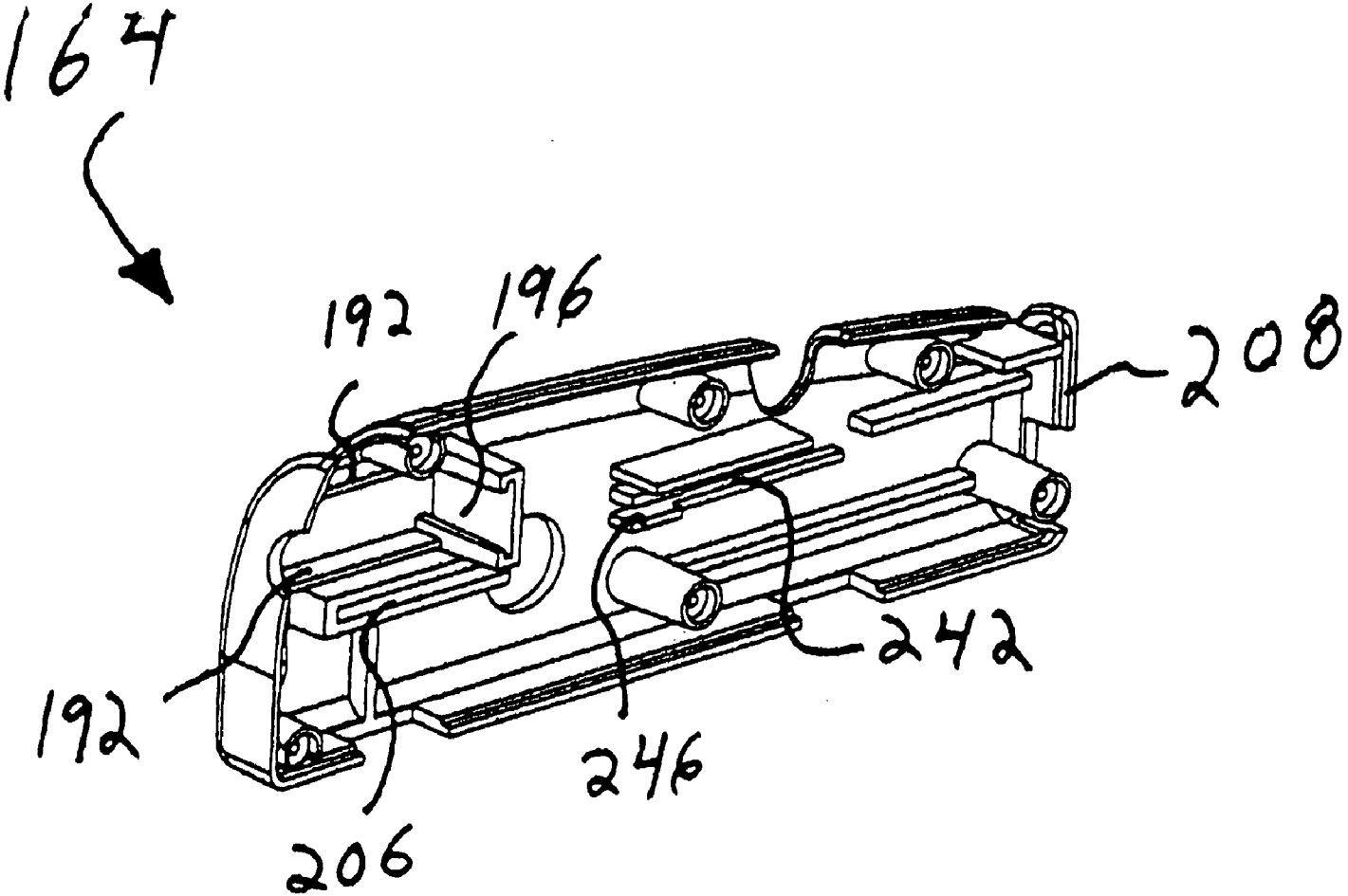
FIG. 7 is an elevated perspective view of an interior of a right side inner housing in accordance with the present invention.
Figure 8:
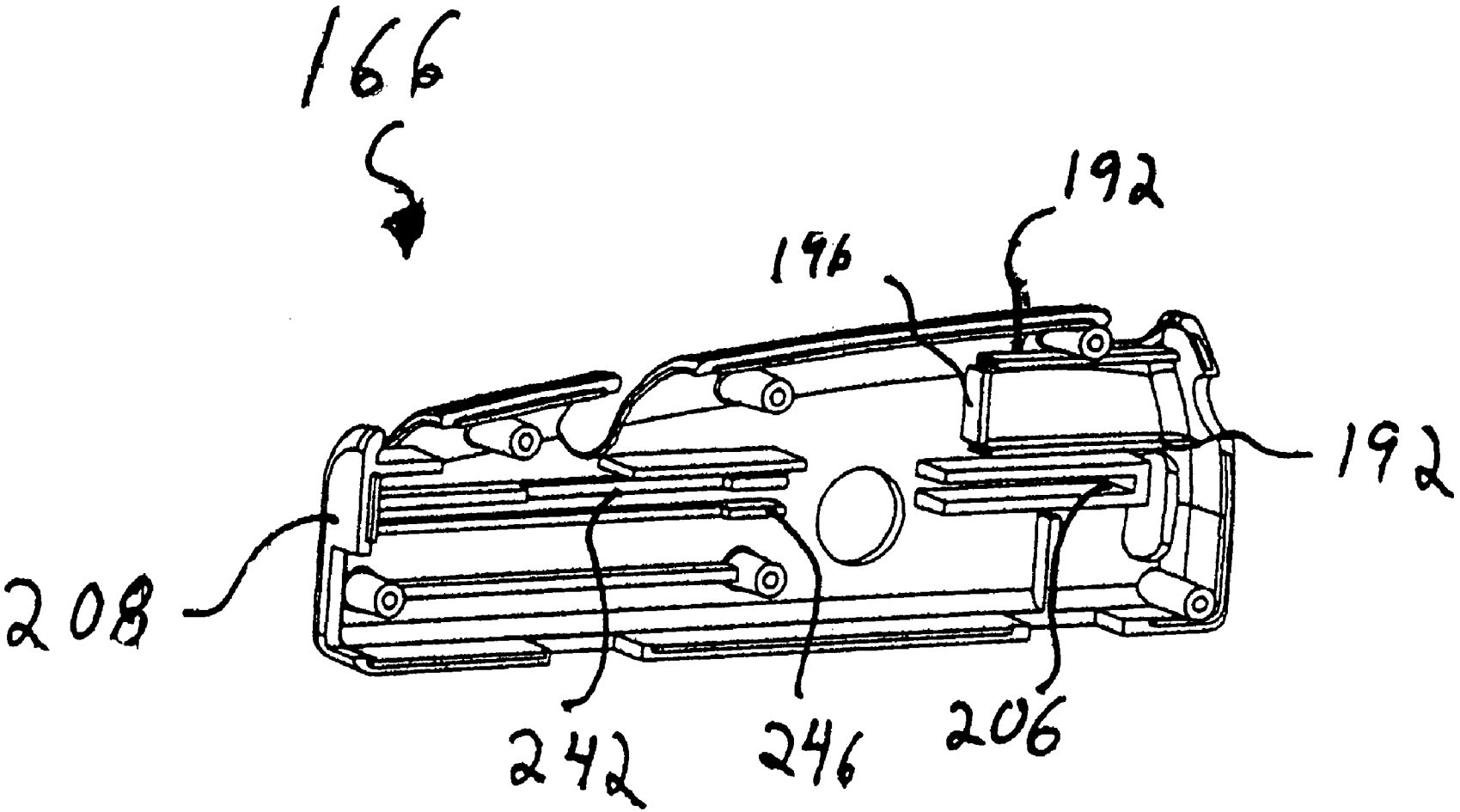
FIG. 8 is an elevated perspective view of an interior of a left side inner housing in accordance with the present invention.
Figure 9:
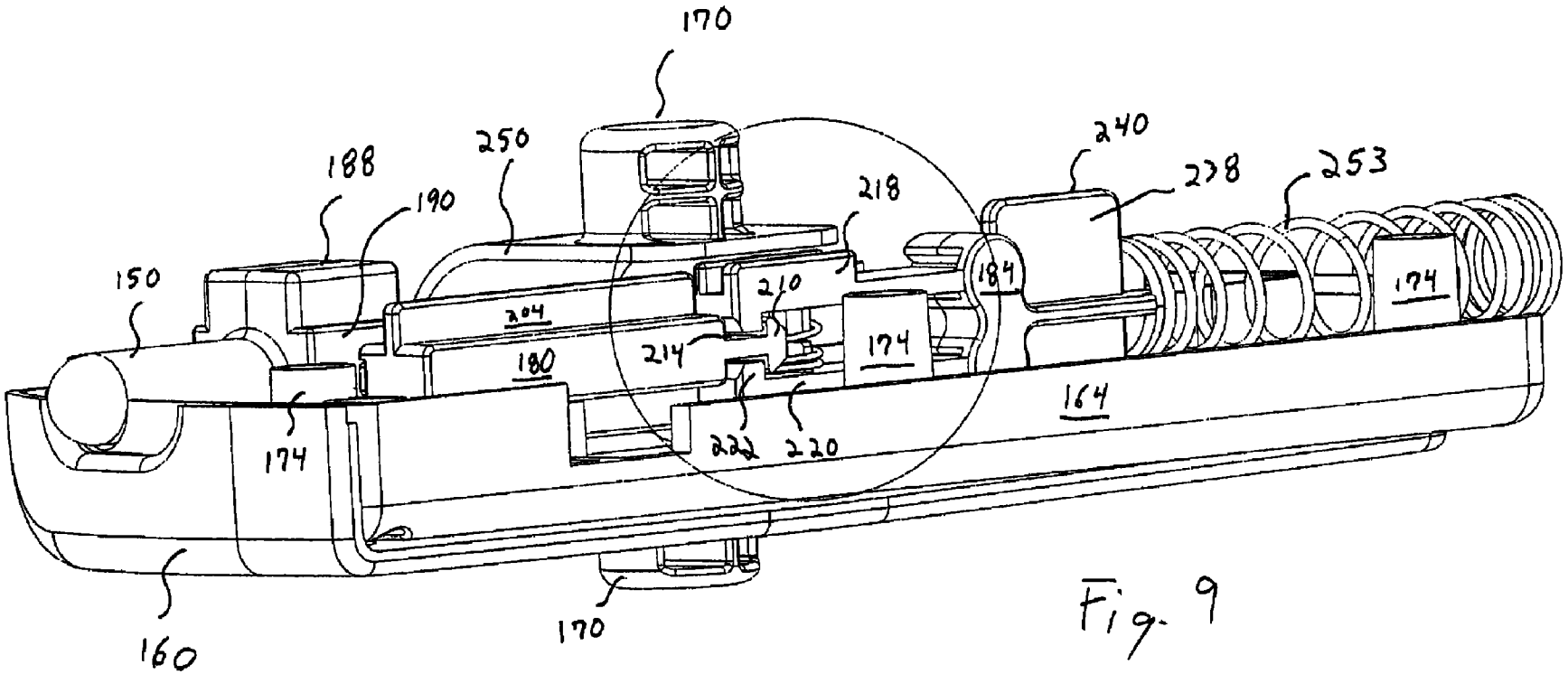
FIG. 9 is an elevated profile view of the exemplary latch handle assembly of FIG. 4, with the inner and outer left side housings removed.
Figure 10:
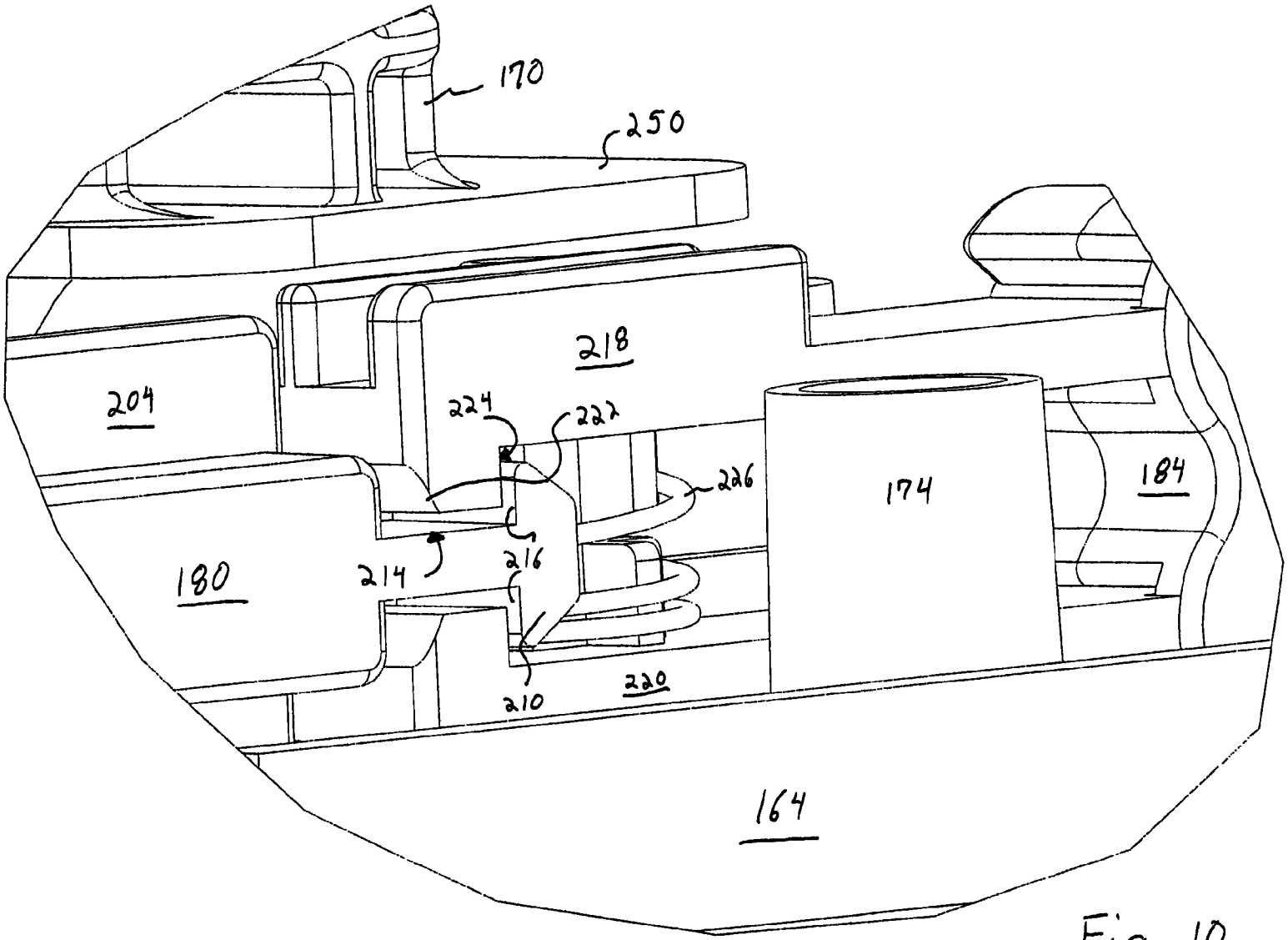
FIG. 10 is an enlarged profile view of a portion of the exemplary latch handle assembly of FIG. 9.
Figure 12:
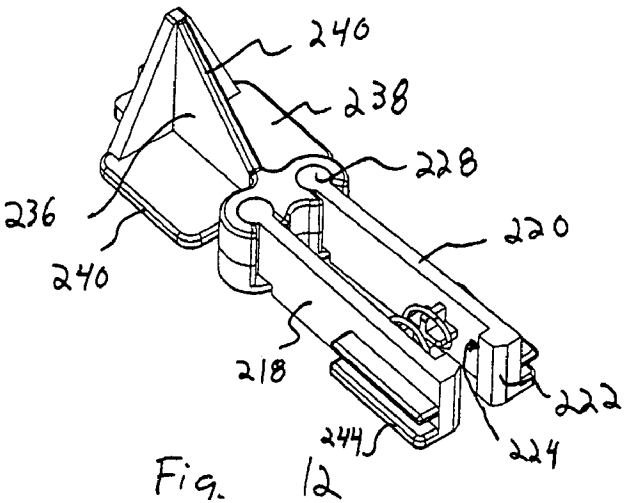
FIG. 12 is an assembled, elevated perspective view of the components of FIG. 11.
Figure 11:
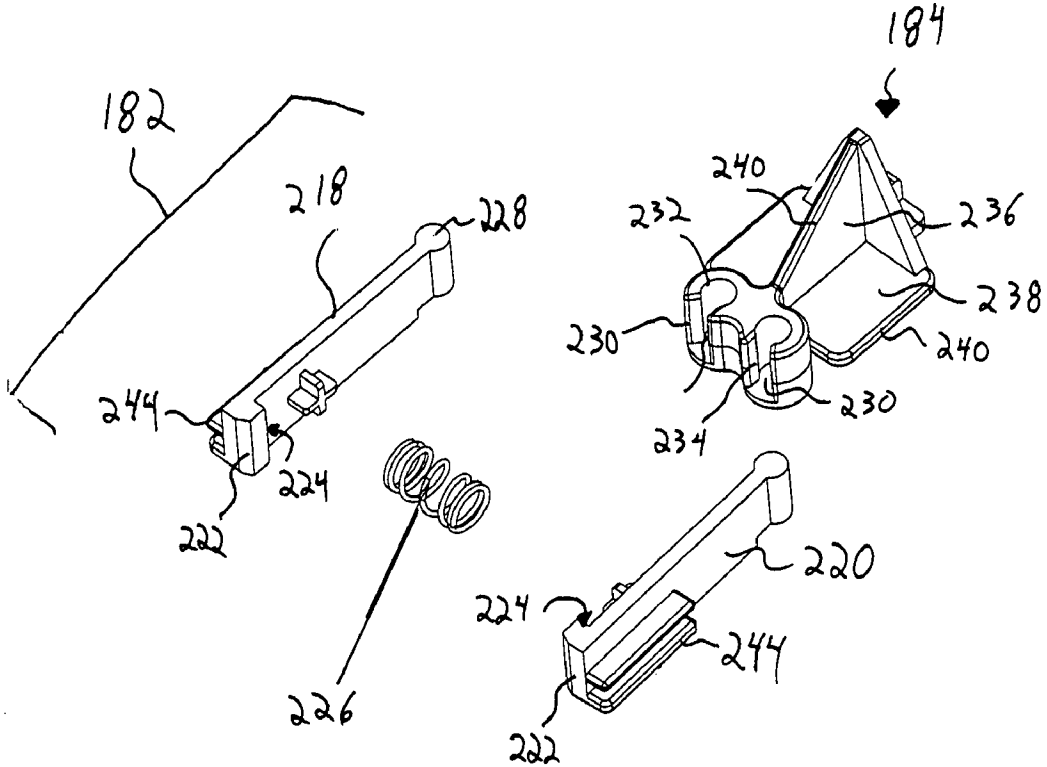
FIG. 11 is an exploded view of a portion of the clutch and cam components in accordance with the present invention.

Referring to FIGS. 4-6, the repositionable pin 178 includes a forward dowel 150 having a generally cylindrical cross section that transitions into a domed endpoint 152. A rear aspect 188 of the pin 178 integrally formed with the dowel 150 has a predominantly rectangular cross-section that includes opposed rectangular projections 190 extending from each lateral side. These rectangular projections 190 are seated between parallel raised walls 192 extending from the interior of each of the right and left inner housings 164, 166, which cooperate to form a track within which the pin 178 is repositioned longitudinally. A rear side of the pin 178, opposite the dowel 150, is hollowed out to form a cylindrical cavity (not shown) that receives a spring 194, which is at least partially compressed between the pin 178 and a rear endpoint 196 of the track. A downwardly extending projection 198 of the pin 178 is seated within a longitudinal channel 200 of the pin guide 180 so that when the pin 178 is in its most forward position, the projection 198 abuts a front wall 202 partially defining the channel 200. A pair of longitudinal fins 204, extending from the lateral sides of the pin guide 178, are received within corresponding longitudinal grooves 206 formed within the interior of the complimentary right and left inner housings 164, 166. When the pin guide 180 is repositioned, the fins 204 ride within the grooves 206 to assure that the movement of the pin guide with respect to the inner housings is substantially linear.

As discussed previously, the top of the pin guide 180 includes a channel 200 acting as a guide for the projection 198 of the pin 178. Because the pin 178 and pin guide 180 are not rigidly coupled to one another, independent actuation of the pin 178 toward the rear 208 of the inner housings 164, 166 would longitudinally reposition the projection 198 within the channel 200, while the channel may or may not stay in position. Likewise, if the pin 178 was moved to a position where the spring 194 was maximally compressed against the rear endpoint 196 of the track, the pin guide 180 could be repositioned longitudinally without changing the position of the pin 178 as the pin would remain stationary while the channel 200 was repositioned.

Referring to FIGS. 4-6, 9, and 10, an arrow shaped hitch 210 extends from the rear of the pin guide 180 and interacts with the clutch 182 to selectively link the cam 184 to the pin guide 180. The hitch 210 includes a rearmost tapered head 212 and a pair of recesses 214 each having a distal stop 216 that selectively interacts with one of the biased arms 218, 220 of the clutch 182.

Referencing FIGS. 4 and 7-12, each of the arms 218, 220 of the clutch 182 includes a tapered detent 222 to be received within one of the recesses 214 of the hitch 210 (see FIGS. 5, 6, and 10), where a substantially perpendicular surface 224 of the detent 222 abuts a substantially perpendicular surface of each of the stops 216 when the clutch 182 engages the pin guide 180. To inhibit unwarranted engagement between the arms 218, 220 and the hitch 210, a spring 226 is positioned therebetween and mounted to each of the arms 218, 220 to force the arms away from one another and out of the line of travel of the hitch 210. Each arm 218, 220, opposite the detent 220, includes a cylindrical end 228 that is received within a corresponding cylindrical cavity 230 of the cam 184 in order to mount the arms to the cam. Each cylindrical cavity 230 includes an open top 232 with a vertically oriented opening 234 enabling rotational movement of the arms 218, 220 with respect to the cam 184. It is important to note that the width of the opening 234 is less than the diameter of the cylindrical end 228 to inhibit the end 228 from pulling through the opening 234, while the closed bottom of the cavity 230 inhibits the cylindrical end 228 from vertically passing therethrough. A distal portion of the cam 184 includes a right triangular panel 236 perpendicularly mounted to a platform 238. An exposed surface 240, comprising the hypotenuse of the triangular panel 236, slides upon the exterior cylindrical surface of the follower 186 when the inner housings 164, 166 are pivoted with respect the outer housings 160, 162. Each lateral end 240 of the platform 238 is received within a corresponding groove 242 formed within the right and left inner housings 164, 166, 144 and operate to guides the cam 184 in a longitudinally linear path parallel to the paths of the arms 218, 220 that have their own guides 244 that receive corresponding projections 246 from the inner housings 164, 166.

Referencing FIGS. 1, 9, 12 and 13, repositioning of the door 108 from its barrier position or to its barrier position involves manipulation of the gate latch 120. For purposes of explanation, it is presumed that the repositionable door 108 is in its barrier position and the foregoing explanation will detail how to reposition the door 108 and how the corresponding assemblies 122, 124 are repositioned to carry this out. As discussed previously, a dowel 150 extending from the latch handle assembly 122 is received within a recess 154 of the latch catch assembly 124 to maintain the door 108 in its barrier position.

A user desirous of repositioning the gate door 108 to either the inbound side 116 or the outbound side 118 of the doorway must first engage the clutch 182 by depressing one or both of the buttons 170 that extend through the outer housings 160, 162. Depression of one or both buttons causes an inner surface of the clip 250 to abut the outer surface of at least one of the biased arms 218, 220 and overcome the bias exerted by the spring 226 and reposition at least one of the detents 222 within at least one of the recesses 214 of the hitch 210. While continuing to depress one or both buttons 170 so that at least one of the detents 222 is received by at least one of the recesses 182, the outer housings 160, 162 are pivoted with respect to the inner housings 164, 166 by applying pressure to the top rear 252 of the outer housings. This pivoting motion of the outer housings 160, 162 causes the cam 184 to contact the follower 186 and overcome the bias of the cam spring 253 so that the cam can be displaced rearward, away from the front 254 of the housings. As the cam 184 is moved rearward, the biased arms 218, 220 are likewise moved rearward at the same time and to the same extent as the cam 184. When the biased arms 218, 220 are repositioned rearward, the substantially perpendicular surface 224 of at least one the detent 222 abuts the substantially perpendicular surface of at least one of the stops 216 so that continued rearward movement of the biased arms 218, 220 results in a corresponding rearward movement of the pin guide 180. Continued rearward movement of the cam 184, biased arms 218, 220, and pin guide 180 is operative to secure the detents 222 within the recesses 214 so that further depression of the buttons 170 is unnecessary. In this manner, the user can simply continue pressure on the rearward portion of the outer housings 160, 162 to continue the rearward movement of the cam 184, biased arms 218, 220, and pin guide 180.

When the pin guide 180 is repositioned toward the rear 252 of the inner housings 164, 166, the front wall 202 effectively pulls the pin 178 rearward by the pushing action of the front wall 202 against the pin projection 198 to overcome the bias of the spring 194. This rearward motion of the pin 178 causes the dowel 150 to be withdrawn from the latch recess 154 of the latch catch assembly 124. After the dowel 150 is withdrawn from the latch recess 154, the door 108 may be repositioned by swinging either to the inbound side 116 or the outbound side 118 of the doorway. After the door 108 is repositioned either to the inbound 116 or the outbound side 118 so that the dowel 150 is no longer aligned with the latch recess 154, the pressure upon the top rear 252 of the outer housings 160, 162 may be released, thereby allowing the pin 118 to extend to its static engaged position. It is to be understood, however, that the foregoing sequence should be repeated any time it is desirous to retract the pin 118, such as an instance where one attempts to secure the door 106 in its barrier position.

When the door 108 is in its open or unengaged position, a user simply directs the door 108 toward the barrier position by contacting the domed end 152 of the dowel 150 with one of the angled faces 156 of the latch catch assembly 124. By forcing the dowel 150 against one of the angled faces 156, the force is operative to overcome the bias of the spring 194 and direct the dowel 150 rearward and farther into the inner housings 164, 166. It should be noted that when the pin 178 is traveling rearward, the position of the pin guide 180 may remain stationary. In this manner, movement of the pin 178 with respect to the pin guide 180 is independent because the pin 178 is not rigidly fastened or coupled to the pin guide 180. After the dowel 150 passes beyond one of the angled faces 156, the bias of the spring 194 forces the dowel 150 to extend into the recess 154, where it is retained to maintain the door 108 in the barrier position.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A gate latch assembly comprising:

a biased latchbolt moved between a retracted position and an extended position;

a latchbolt catch to receive the latchbolt; and a two-stage mechanism for repositioning the latchbolt from the extended position to the retracted position, the two-stage mechanism comprising a button structure, a clutch member having, first and second contacting surfaces, a biasing member, and an inner operating member having a follower therein and moved between a non-operating position and an operating position;

wherein the first stage the mechanism is operated by pushing the button structure to engage the first contacting surface of the clutch member with the latch bolt and, the second stage of the mechanism is operated by moving the inner operating member toward the operating position so as to allow the follower to move along the second contacting member of the clutch member to allow the latch bolt to be retracted; wherein when the inner operating member is returned to the non-operating position, the first contacting surface of the clutch member is biased to disengage the latch bolt.

2. The gate latch assembly of claim 1, wherein the inner operating member comprises first and second covering members partially covering the clutch member; wherein the second covering includes the follower.

3. The gate latch assembly of claim 2, wherein;

the first covering includes complementary panels majorily enclosing the two-stage mechanism; and the complementary panels cooperate to form guides to guide the movement of the latchbolt between the extended position and the retracted position.

4. The gate latch assembly of claim 2, wherein:

the latchbolt includes a repositionable pin traversing along a pin guide;

the pin includes a projection or a cavity that engages the pin guide to selectively reposition the pin when the pin guide is repositioned; and the pin guide is selectively engaged by the clutch.

5. The gate latch assembly of claim 4, wherein:

the pin includes a proximal projection;

the pin includes alignment features that interact with corresponding features of the first coveting to guide traversal of the pin;

the first covering includes an orifice though which the proximal projection extends in the extended position; and the second covering includes an office through which the proximal projection extends in the extended position.

6. The gate latch assembly of claim 1, wherein:

the first contacting surface of the clutch member includes two pivotally mounted arms adapted to be moved by operation of the button structure, each arm includes a detent to engage a corresponding cavity of the latchbolt when the button structure is pushed, and the arms are biased apart from one another to inhibit engagement of each detent with its corresponding cavity of the latchbolt when the button structure is released.

7. A repositionable barrier comprising:

a gate frame;

a repositionable gate door cooperating with the gate frame to provide a barrier across an area having a width and a height cooperatively defined by the gate frame and gate door when the gate door is in a closed position; and a gate latch assembly comprising:

a biased latchbolt moved between a retracted position and an extended position;

a latchbolt catch to receive the latchbolt and a two-stage mechanism for repositioning the latchbolt from the extended position to the retracted position, the two-stage mechanism comprising a button structure, a clutch member having first and second contacting surfaces, a biasing member and an inner operating member having a follower therein and moved between a non-operating position and an operating position;

wherein the first stage of the mechanism is operated by pushing the button structure to engage the first contacting surface of the clutch member with the latch bolt and the second stage of the mechanism is operated by moving the inner operating member toward the operating position so as to allow the follower to move along the second contacting member of the clutch member to allow the latch bolt to be retracted; wherein, when the inner operating member is returned to the non-operating position the first contacting surface of the clutch member is biased to disengage the latch bolt.

8. The gate latch assembly of claim 7, wherein the inner operating member comprises first and second covering members partially covering the clutch member; wherein the second covering includes the follower.

* * * * *